United States Patent [19]

Lastik

[11] 4,225,043

[45] Sep. 30, 1980

[54] SECURING PADS FOR SHEET SHIPPING CONTAINERS

[75] Inventor: Joseph P. Lastik, Greensburg, Pa.

[73] Assignee: PPG Industries, Inc., Pittsburgh, Pa.

[21] Appl. No.: 36,882

[22] Filed: May 7, 1979

Related U.S. Application Data

[63] Continuation-in-part of Ser. No. 927,082, Jul. 24, 1978, abandoned.

[51] Int. Cl.[3] ..... B65D 19/00

[52] U.S. Cl. ..... 206/448; 206/386

[58] Field of Search ..... 206/448, 386; 220/445

[56] References Cited

U.S. PATENT DOCUMENTS

| | | | |
|---|---|---|---|
| 2,919,022 | 12/1959 | Lidgard | 206/448 |
| 3,414,124 | 12/1968 | Lidgard | 206/448 |

*Primary Examiner*—George T. Hall

*Attorney, Agent, or Firm*—Donald C. Lepiane

[57] ABSTRACT

Automotive lites, e.g., windshields are secured in a shipping container by positioning a foamed polyethylene pad on edge portion of a windshield and urging the pad and windshield edge portion into corresponding slot of spaced logs mounted on the container.

20 Claims, 8 Drawing Figures

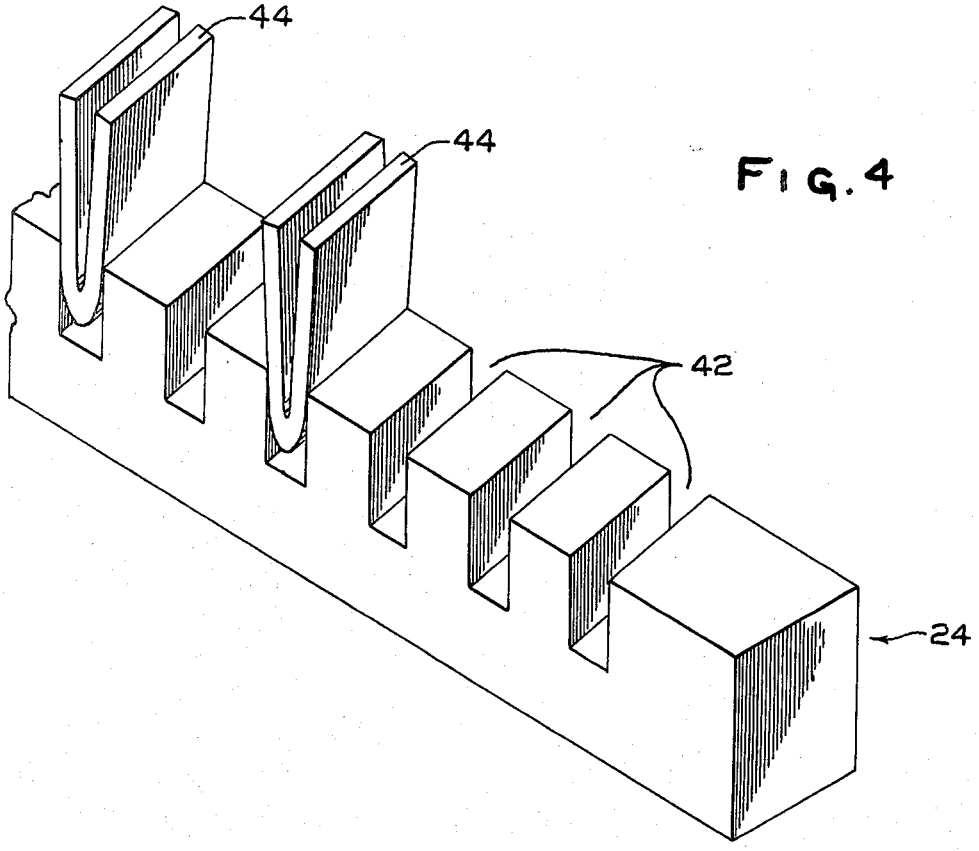
FIG. 4
FIG. 5
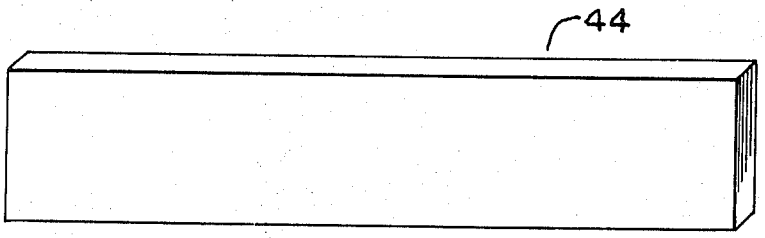
FIG. 6
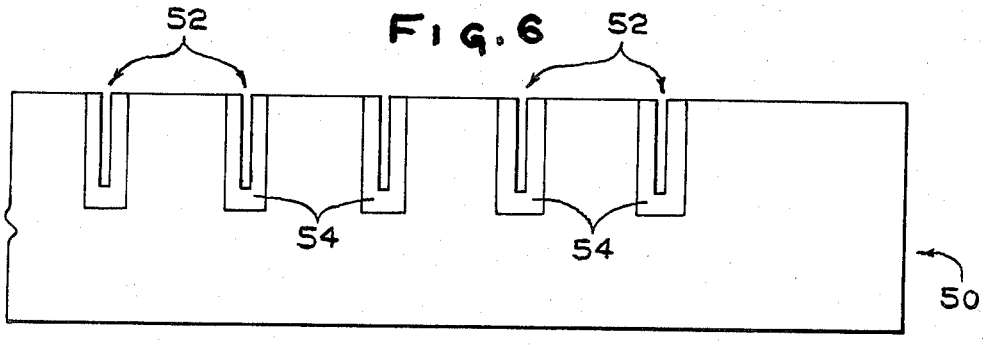

SECURING PADS FOR SHEET SHIPPING CONTAINERS

CROSS REFERENCE TO RELATED APPLICATION

This application is a continuation in part of U.S. patent application Ser. No. 927,082 filed on July 24, 1978 in the name of J. P. Lastik for "Securing Pads for Sheet Shipping Containers." now abandoned.

BACKGROUND OF THE INVENTION

1. Field of the Invention

This invention relates to a pad for securing sheets, for example, automotive lites in slotted logs of shipping and/or handling containers.

2. Description of the Technical Problems and Prior Art

U.S. Pat. Nos. 2,919,022 and 3,414,124 teach a container for handling and/or storing automotive lites, e.g., windshields. In general, the container includes a wire-bound crate having side walls, a top wall, a bottom wall and a pair of spaced slotted logs secured on the bottom wall. A pair of paperboard stabilizers each having an adhesive surface are wrapped around edge portions of the windshield in spaced relation to one another and biased against the windshield e.g. by pins. The bottom edge of the mounted stabilizers have a groove which receives a respective log when the stabilizer is mounted in a slot of the log. Longitudinal motion of the windshield is prevented by (1) the biasing pins and/or adhesive maintaining the pad on edge portions of the windshield and (2) the walls of the groove formed in the bottom edge of the mounted stabilizer engaging the sides of the slotted logs.

Although the stabilizers taught in the above-mentioned patents are acceptable, there are limitations. One of the limitations is that the windshields must be clean before the stabilizers are positioned thereon. This is because a film of dust, if any, on the windshield prevents adhesion of the stabilizers to the windshield. When this occurs, the transportation forces which act on the windshield during shipment and/or handling of the loaded container will shift the windshield which may result in damage to the edges of the windshield. Another limitation is that the adhesive on the windshield must be removed so as not to affect the mounting of the windshield and/or for aesthetic appeal. The removal of the adhesive requires additional handling of the windshield which increases its cost.

It would be advantageous, therefore, to provide stabilizers or pads for securing sheets in shipping and/or handling containers that do not have the limitations of the prior art stabilizers.

SUMMARY OF THE INVENTION

This invention relates to a sheet shipping container of the type having a pair of spaced elongated members each having at least one slot. The sheet to be shipped, e.g., automotive lite has edge portions mounted in the at least one slot of each member. During shipment and/or handling of the at least one sheet, transportation forces move the sheet along a path e.g. a reciprocating path generally transverse to longitudinal axis of the elongated members. The instant invention contemplates facilities, e.g., a resilient, compressible pad, mounted in the at least one slot of a member and compressed between the wall of the at least one slot and adjacent sheet portion for applying a biasing force about the sheet portion equal to or greater than the transportation forces acting to displace the sheet.

The invention further relates to a method of loading at least one sheet in a shipping and/or handling container. A pair of elongated members having at least one slot are mounted in spaced relation to one another in the container. The sheet is urged in the at least one slot of at least one member as a biasing force is applied to the sheet portion in the at least one slot. The biasing force applied to the sheet portion is equal to or greater than transportation forces which act to displace the sheet during shipment thereof.

BRIEF DESCRIPTION OF THE DRAWING

FIG. 4 is an isometric view of a slotted log used in the container shown in FIGS. 1–3 having a securing pad of the instant invention mounted in selected slots for receiving an edge portion of a windshield;

FIG. 5 is an isometric view of the pad of the instant invention;

FIG. 6 is a side view of a slotted log used in sheet shipping and/or handling containers and incorporating features of the invention.

DESCRIPTION OF THE INVENTION

Figure 1:
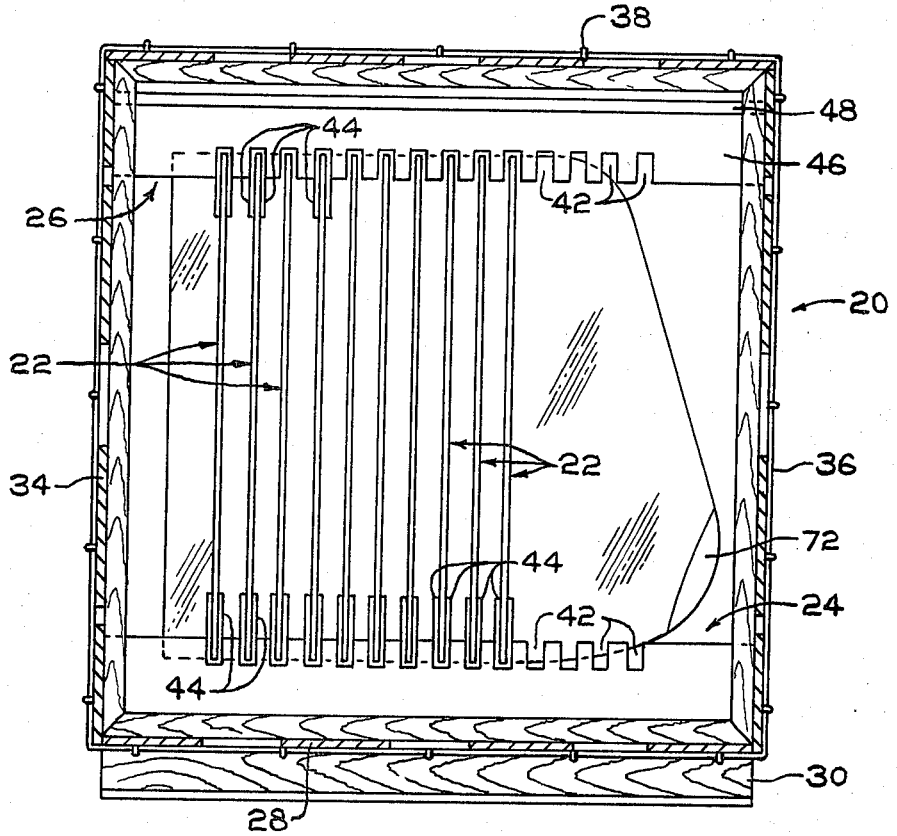
FIG. 1 is a side view of a container loaded with automotive backlites in accordance with the teachings of the invention.
Figure 2:
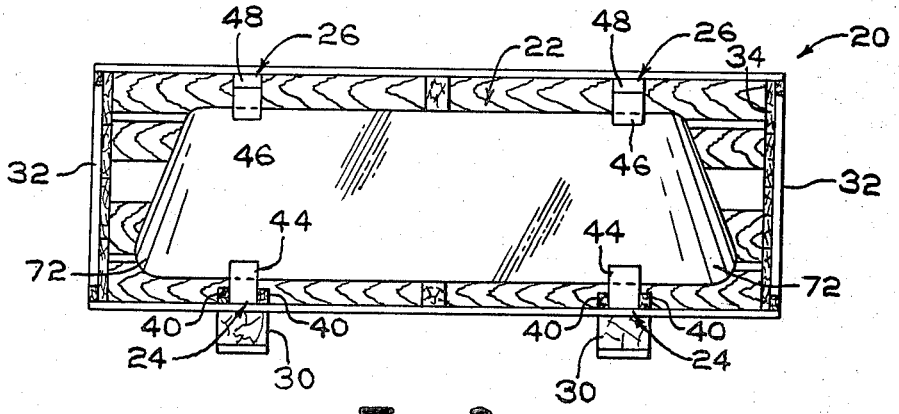
FIG. 2 is a frontal view of the container shown in FIG. 1 with the front and top walls of the container removed for purposes of clarity.
Figure 3:
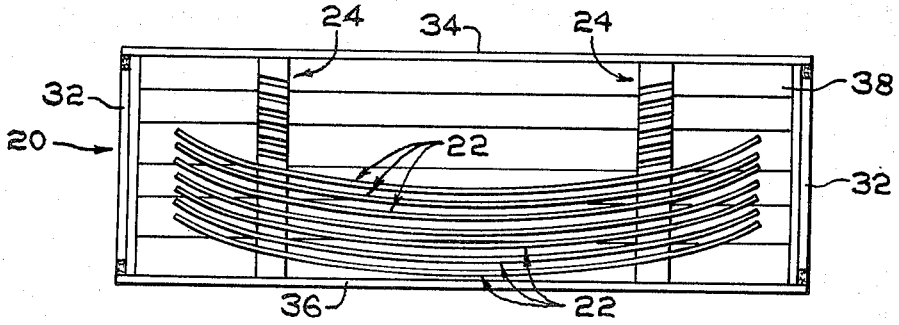
FIG. 3 is a top view of the container shown in FIG. 2.

Referring to FIG. 1 there is shown container 20 having a plurality of sheets 22 mounted in spaced relation to one another in bottom slotted logs or bottom slotted elongated members 24 and upper slotted logs or upper slotted elongated members 26 in accordance with the teachings of the invention. In general, the container 20 includes a base 28 supported on runners 30 (shown in FIGS. 1 and 2) to provide clearance for lifting the loaded container, e.g., with a fork lift truck (not shown); opposed end walls 32 shown in FIGS. 2 and 3; back wall 34 shown in FIGS. 1–3; front wall 36 shown in FIG. 1; and top wall 38 shown in FIG. 1. The container 20 is not limiting to the invention and may be a wire-bound container as shown in FIGS. 1–3 or may be a pressed corrugated fiberboard container of the type used in the art for shipping one or more sheets. Further, the invention is not limited to the number of sheets shipped in the container.

With specific reference to FIG. 2, each of the bottom slotted logs 24 are mounted in a groove formed by a pair of rigid strip members 40 advantageously mounted on the base 28. Longitudinal movement of the logs 24, i.e., reciprocal movement between container end walls is prevented by the members 40, and lateral movement of the logs 24 is prevented by the front wall 36 and back wall 34. With reference to FIG. 4 the logs 24 and 26 which are not limiting to the invention, normally made of laminated, pressed, corrugated fiberboard having a plurality of slots 42 cut therein for receiving edge portions of a sheet 24. To maintain the sheets in spaced relation to one another and securing pads 44 to prevent or minimize sheet movement during shipment. For example and with reference to FIGS. 1 and 2, a securing pad 44 is shown mounted in the slot of the bottom left log and upper left log to the immediate right of the container backwall 34 e.g. slot number 1; a pad 44 is mounted in slot members 2 and 4 of the upper left log 26 and a pad 44 is mounted in slot members 3 and 5–10 of the bottom left log 24. The same schedule may be used for the right upper and right bottom logs as shown in FIG. 2 or in the alternative, the slots of the right upper and right bottom logs may have a pad and corresponding slots of the left upper and left bottom logs may not.

With reference to FIG. 1 the upper logs 26 which are similar to the bottom logs 24 may be secured in position in a similar manner as the bottom logs 24 or may be nailed or stapled in position. For example, the upper logs 26 may include slotted, laminated, pressed, corrugated fiberboard 46 advantageously joined to a wooden member 48. Nails (not shown) pass through the back wall 34 and front wall 36 into adjacent end of the member 48 to secure the upper logs 26 in position. As will become apparent, the invention is not limited to the log construction or the number of slots in the logs 24 and 26. Further, the slotted logs 24 and 26 and the manner in which the logs are secured in the container 20 is not limiting to the invention and are presented to illustrate an environment in which the invention may be practiced. A complete discussion of the container 20 and slotted logs 24 and 26 may be had by reference to U.S. Pat. No. 2,919,022 which teachings are hereby incorporated by reference.

The discussion will now be directed to the securing pads 44 incorporating features of the invention for preventing longitudinal displacement of the sheets 22 e.g. longitudinal displacement of the sheets relative to the logs during shipment and/or handling thereof. With specific reference to FIGS. 4 and 5, the pads 44 each having a generally rectangular shape are made of resilient, compressible material. A pad is folded and placed in selected slots 42 of the upper and bottom logs as shown in FIG. 4 for the bottom leg 24. Edge portion of a sheet 22 and the pad 44 are urged together to move the pad 44 over edge portion of the sheet 22 and into the slot 42. As the pad 44 moves into its respective slot, it is compressed but because it is resilient it continually applies a biasing force against the engaged sheet portion. It is the biasing force that prevents longitudinal displacement of the sheet 22 relative to the logs. Stated another way, the biasing force applied to the sheet by the pad is equal to or greater than the transportation forces which act on the sheet to move it along a reciprocating path transverse to the longitudinal axis of the logs. Upward movement of the sheet is prevented or minimized by the upper logs 26 and lateral motion of the sheet is prevented or minimized by the walls of the slots 42 of the logs 24 and 26.

It is believed that the following parameters affect the biasing force of a pad in a slot which prevent or minimize longitudinal displacement of the sheet engaged by the pad during handling and/or shipment of the sheet. The parameters are (1) coefficient of friction of the engaging surface of the pad 44; (2) resiliency of the pad 44; (3) thickness of the pad 44; (4) spaced distance between the walls of slot 42; (5) depth of the slot 42; (6) width of the slot 42; and (7) engaging surface area of the pad 44. As the coefficient of friction of the engaging surface of the pad 44 increases, with the remaining parameters constant, the biasing force increases and vice versa. As the resiliency of the pad 44 increases with the remaining parameters constant, the biasing force increases and vice versa. As the thickness of the pad 44 increases with the remaining parameters kept constant, the biasing force increases and vice versa. As the spaced distance between the walls of the slot 42 decreases with the remaining parameters constant, the biasing force increases and vice versa. As the depth of the slot 42 increases with the remaining parameters constant, the biasing force increases. When there is no longer portions of the pad to be inserted in the slot, increase the depth of the slot has no effect on the biasing force because there is no pad to compress. As the width of the slot 42 increases up to the width of the pad 44 with the remaining parameters constant, the biasing force increases and vice versa. When the width of the slot 44 exceeds the width of the pad 42, the excess width of the slot 42 does not increase the biasing force because there is no pad to compress. As the engaging surface area of the pad increases up to the width of the slot 44 with the remaining parameters constant, the biasing force increases and vice versa. When the engaging surface area of the pad exceeds the width of the slot the excess surface area of the pad acts as a wedge to further resist movement of the sheet.

The interaction of the above parameters may be appreciated from the following example. A pair of bottom slotted logs 24 each about 29 inches (0.73 meters) long, about 7 inches high (17.78 centimeters) and about 3 inches wide (7.62 centimeters) were mounted on a center to center spacing of about 28 inches (0.7 meters) on base 28 of container 20. Slots 42 formed in the logs 24 had a spacing between walls of about $\frac{3}{8}$ inch (0.95 centimeters); a depth of about 5 inches (12.7 centimeters); a width of about 3 inches (7.6 centimeters) and a center to center spacing between slots 42 of about 1 5/32 inches (2.94 centimeters). Pads 44 made of foamed polyethylene having a density of 1.4 pound per cubic feet (0.022 grams per cubic centimeter); a thickness of about $\frac{1}{8}$ inch (0.3 centimeters); a length of about 9 inches (22.86 centimeters) and a width of about 2 inches (5.08 centimeters) were set in each slot 42 of the bottom logs 24. Edge portion of a windshield having a thickness of about $\frac{1}{4}$ inch (0.64 centimeters) was set between the pad and the windshield urged downward to set the pad and engaged windshield portions into the slot 42. Upper logs 26 were secured in position using nails as previously discussed. The loaded container 20 was shipped by truck from Greensburg, Pa. to Denver, Colo. The loaded container upon receipt at Denver was studied and it was observed that the windshields did not shift due to transportation and/or handling forces.

A container 20 similar to the one described above was loaded with windshields having a thickness of about 3/32 inch (0.24 centimeters). The loaded windshields were longitudinally displaced by hand. The single pad for each slot was replaced by two $\frac{1}{8}$ inch (0.32 centimeters) thick pads. The loaded container was shipped from Greensburg, Pa. to Twinsburg, Ohio. Upon receipt of the container at Twinsburg, it was studied and observed that there was no longitudinal displacement of the sheets relative to the logs.

As can be appreciated, the invention is not limited to the material used in the practice of the invention, e.g., leather and/or polymer materials such as rubber and foamed polyethylene may be used. However, the material selected for the pads should have sufficient resiliency to apply a biasing force on the sheets when the sheet and pad are mounted in a slot to prevent sheet displacement during shipment of the container. In this regard, it is generally accepted that the transportation forces result from vertical shock; vertical vibrations; lateral shock; lateral vibrations; longitudinal shock; and longitudinal vibrations. The maximum transportation forces are generated by railcars and are as follows. The vertical shock has a minimum force of about 2 g's (where g is force of gravity) and peaks at about 4 g's. The vertical vibrations have a continuous force of about ¼ g at a frequency of about 3–8 cycles per second and a maximum force of about 2 g's. Lateral shock i.e., shock perpendicular to the direction of vehicle travel has a force of about ½ g at the bed of the railcar and up to about 5 g's at the top of the load. Lateral vibration, i.e., vibrations perpendicular to the direction of vehicle advance have a continuous force range of about 0.4–1 g at about 2 cycles/second. The longitudinal shock has a force range of about 3–13 g's. The longitudinal vibrations are negligible. For over the road trailers the above forces are less.

In practice, to determine if the pad material and/or dimensions are acceptable, a sheet may be loaded in a container using the pad to be tested. The container may be shipped and/or tested in a laboratory to simulate expected transportation forces. The laboratory testing may include a vibration tester and/or Conbur Incline Impact Tester. If the sheet is displaced by the transportation forces, changes to the dimensions of the pad or log may be made or a different material selected in accordance to the above discussion.

With reference to FIG. 6 there is shown a slotted log 50 incorporating features of the invention. The slotted log 50 is similar in construction to the logs 24 and 26 except that the slots 52 of the log 50 have a lining 54. The lining 54 is made of a compressible, resilient material adhered to fiberboard body 55. The lining 54 is used in place of pad 44 shown in FIGS. 4 and 5 to apply a biasing force on the sheets to prevent or minimize longitudinal displacement of the sheets during shipment and/or handling of the container 20. As can now be appreciated, the lining 54 may be used in selected slots 52 of the log 50 as were the pads 44 in the slots 42 of the logs 24 and 26.

Figure 7:
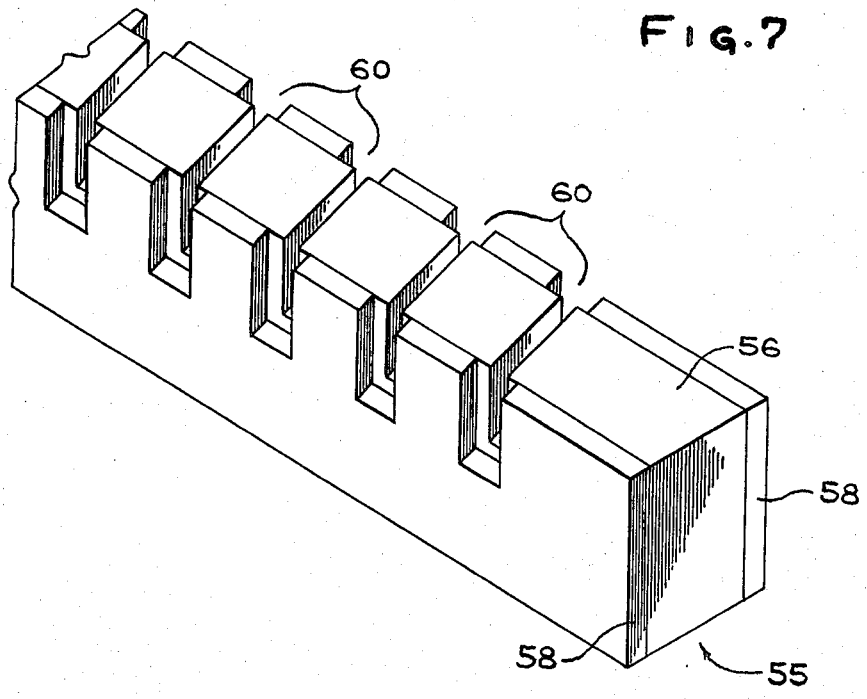
FIG. 7 is an isometric view of an alternate embodiment of a slotted log incorporating features of the invention.

With reference to FIG. 7 there is shown another slotted log 55 incorporating features of the invention. The log 55 is made of an inner layer 56 of compressible, resilient material adhered to outer walls 58 of a rigid material for structural stability. Slots 60 formed in the log 54 receive edge portions of the windshields as the layer 56 to prevent or minimize longitudinal motion of the sheets during shipment of the loaded container by applying a biasing force on the sheet in a similar manner as the pads 44. The outer walls 58 may be made of pressed fiberboard, wood or metal. When the outer walls 58 are made of material that may mar the sheets, e.g., when the sheets are made of glass and the outer walls are made of metal the spaced distance between walls and depth of the slots in the outer walls 58 should be greater than the corresponding dimensions of the slots in the inner layer 56 as is shown in FIG. 7.

Figure 8:
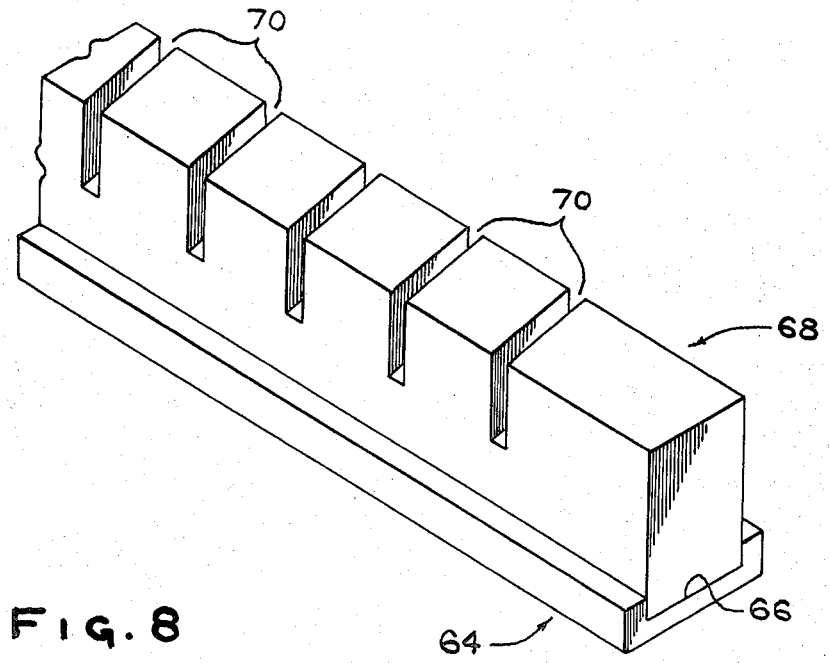
FIG. 8 is an isometric view of still another embodiment of a slotted log incorporating features of the invention.

Shown in FIG. 8 is still another embodiment of a log 62 incorporating features of the instant invention. The log 62 includes a platform 64 made of a rigid material, e.g., wood, metal and/or pressed corrugated fiberboard having groove 66 formed therein for receiving an elongated block 68 of a compressible, resilient material which has a plurality of slots 70 formed therein. The slots 70 are sized to apply a biasing force to the sheets positioned therein equal to or greater than the expected transportation forces. The advantage of the log 62 is that one plateform 64 may be used with different type blocks 68 designed to support flat sheets and/or sheets having compound bends, e.g., automotive windshields or backlites.

As can now be appreciated that the invention is not limited to the type of sheets loaded in the container 20. For example, the sheets may be made of glass, metal, and/or wood; the sheets may be flat and/or curved; and the sheets may be laminated or monolithic, e.g., automotive windshields, side lites or back lites.

DETAILED DESCRIPTION OF THE INVENTION

The invention is employed for shipping 16 windshields, each about ¼ inch (0.635 centimeters) thick with 8 windshields having a compound bend of a first predetermined shape and the remaining 8 windshields having a compound bend of a second predetermined shape.

With reference to FIGS. 1–3, wirebound container 20 of the type taught in U.S. Pat. No. 2,919,022 has end walls 32 having a height of about 32 inches (0.8 meter) and a length of about 29 inches (0.73 meters); front and back walls 36 and 34 respectively, each having a length of about 70 inches (1.75 meters) and height of about 32 inches (0.8 meters); and top and bottom walls 38 and 28, respectively, each having a length of about 70 inches (1.70 meters) and a width of about 29 inches (0.73 meters) A pair of bottom slotted logs of the type taught in the above-mentioned patent made of pressed, laminated, corrugated fiberboard are mounted on the bottom wall 28 of the container 20 in a groove formed by rigid strip members 40 (as shown in FIG. 2) secured to the container bottom wall 28. The bottom logs 24 are mounted on a center to center spacing of about 29 inches (0.73 meters) and each log 24 has a length of about 29 inches (0.73 meters); a height of about 7 inches (17.8 centimeters); and a width of about 3 inches (7.62 centimeters). The logs 24 each have 18 slots 42 having a spacing between walls of the slot of about ⅜ inch (0.95 centimeters); a depth of about 5 inches (12.7 centimeters) and a center to center spacing between slots of about 1 5/32 inches (2.94 centimeters). The slot of each log closest to the container front wall 36 is spaced about 2½ inches (6.35 centimeters) therefrom. The slots are angled with respect to one another to receive edge portion of the windshields.

With reference to FIGS. 4 and 5, foamed polyethylene pads 44 each having a thickness of about ¼ inch (0.64 centimeters); a length of about 11 inches (29 centimeters); a width of about 2 inches (5.08 centimeters) and a density of 1.4 pounds per cubic feet (0.22 grams per cubic centimeter) are folded and placed in slots 1, 3, 5 and 7 of the right bottom log 24 as viewed in FIG. 2, and slots, 2, 4, 6 and 8 of the left bottom log 24 as viewed in FIG. 2 counting from the backwall 34 (see FIG. 1). A 0.005 inch (0.013 centimeters) thick polyethylene tape 72 is folded over and adhered to the bottom corner portions of the windshields 22 as shown in FIGS. 1 and 2 to prevent chipping of the edges due to the windshields contacting one another as they are positioned in the slots 42 of the bottom logs 24. A windshield 22 is placed in the pad 44 contained in a bottom log 24 and the corresponding slot 22 of the other bottom log 24. The windshield is pushed downward to urge the pad 44 into the slot about the windshield. The above is repeated for the remaining windshields of the first group.

Pads 44 are inserted in slots 11, 13, 15 and 17 of one log 24 and slots 12, 14, 16 and 18 of the other log. The second group of windshields are inserted in grooves 11–18 in a similar manner as the first group of windshields were inserted in grooves 1–8 of the bottom logs 24. Upper logs 26 similar in construction to the lower logs 24 and having a 1 ¾ inches thick (4.45 centimeters); 3 inches wide (7.62 centimeters) and 29 inches long (0.73 meter) piece of wood 48 is mounted on the upper edge of the windshields as viewed in FIG. 1. The front and top walls of the container are joined to enclose the loaded sheets. Thereafter the upper logs 26 are secured in position by nails (not shown) passing through the container back wall and front wall 34 and 36, respectively, into ends of the member 48 of the upper logs 26. The container is now ready for handling and/or shipping.

As can be appreciated, the above example is presented for illustration purposes and is not limiting to the invention.

What is claimed is:

1. In a sheet shipping container of the type having a pair of elongated members in spaced relation to one another in the container, each of the members having at least one slot for receiving edge portion of the sheet wherein the sheet is acted on by transportation forces which displace the sheet along a path generally transverse to longitudinal axis of the members the improvement comprising:

means mounted in the at least one slot of at least one elongated member and compressed between the walls of the at least one slot and adjacent sheet portion for applying a biasing force on the sheet portion to prevent displacement of the sheet due to the transportation forces.

2. The container as set forth in claim 1 wherein the container has a base and the members are in spaced relation to one another on the base.

3. The container as set forth in claim 1 wherein the container has a cover and the elongated members are mounted adjacent the cover.

4. The container as set forth in claim 1 wherein said biasing means includes a resilient, compressible pad.

5. The container as set forth in claim 4 wherein said pad is adhered to the walls of the at least one slot.

6. The container as set forth in claim 4 wherein said pad is non-adhering contact with the walls of the at least one slot and the sheet.

7. The container as set forth in claims 4, 5 or 6 wherein the pad is made of foamed polyethylene having a density of 1.4 pounds per cubic feet (0.022 grams per cubic centimeter).

8. The container as set forth in claim 1 wherein the transportation forces include vertical shock up to a force of about 4 g's; vertical vibrations of about ¼ g at a frequency of about 3–8 cycles per second; lateral shock of up to about 5 g's; lateral vibrations of up to about 1 g at 2 cycles per second; and longitudinal shock of up to about 13 g's.

9. The container as set forth in claim 2 wherein the sheet is automotive lites, the container includes a top and opposed side walls, the elongated members are mounted in spaced relation to one another on the base, and the elongated members each have a plurality of slots.

10. A sheet shipping container wherein the sheet to be shipped is acted on by transportation forces which shift the sheet, comprising:

a pair of elongated members of which at least one of said members is made of compressible, resilient material having at least one slot formed therein to apply a biasing force on sheet portion therein to prevent shifting of the sheet by the transportation forces; and means for mounting said members in spaced relation to one another.

11. The container as set forth in claim 10 wherein said at least one member has a pair of opposed outer walls and further including mounted on each wall of said at least one member, said layer made of material is less compressible and resilient than the material of said at least one member.

12. The container as set forth in claim 10 wherein the container has a base, said elongated members are mounted in spaced relation to one another on the base and said mounting means to mount said at least one member includes:

a platform having a groove for receiving said at least one member; and said platform mounted on the base.

13. The container as set forth in claim 10 wherein the container has a cover and said members are mounted in spaced relation to one another between the cover and sheet.

14. The container as set forth in claims 10, 11, 12 or 13 wherein said compressible, resilient member is made of foamed polyethylene having a density of 1.4 pounds per cubic feet (0.022 grams per cubic centimeter).

15. The container as set forth in claim 12 wherein the sheet is automotive lites, the container further includes a top wall and opposed side walls, the elongated members are mounted in spaced relation to one another on the base and the elongated members each have a plurality of slots.

16. A method of shipping at least one sheet, comprising the steps of:

mounting edge portion of a sheet in a slot formed in each of a pair of spaced elongated members; while applying a biasing force to sheet portion in at least one of the slots to prevent displacement of the sheet during shipment thereof.

17. The method as set forth in claim 16 wherein said mounting step includes the step of:

applying a tape to edge portion of the sheet.

18. The method as set forth in claim 17 wherein the sheet is automotive lites.

19. The method as set forth in claim 16 wherein the sheet is vertically mounted and said applying step is practiced on bottom edge portion of the sheet.

20. The method as set forth in claim 16 wherein the sheet is vertically mounted and said applying step is practiced on top edge portion of the sheet.

* * * * *